US009078296B2

(12) United States Patent
Fitzwater

(10) Patent No.: US 9,078,296 B2
(45) Date of Patent: Jul. 7, 2015

(54) TRAY WITH CURVED BOTTOM SURFACE

(75) Inventor: Kelly R. Fitzwater, Lakewood, CO (US)

(73) Assignee: Graphic Packaging International, Inc., Atlanta, GA (US)

( * ) Notice: Subject to any disclaimer, the term of this patent is extended or adjusted under 35 U.S.C. 154(b) by 97 days.

(21) Appl. No.: 13/490,546

(22) Filed: Jun. 7, 2012

(65) Prior Publication Data

US 2012/0312807 A1 Dec. 13, 2012

Related U.S. Application Data

(60) Provisional application No. 61/520,345, filed on Jun. 8, 2011.

(51) Int. Cl.

| | |
|---|---|
| ***B65D 5/20*** | (2006.01) |
| ***H05B 6/64*** | (2006.01) |
| ***B65D 81/34*** | (2006.01) |
| ***B65D 5/30*** | (2006.01) |

(52) U.S. Cl.

CPC ..... *H05B 6/6408* (2013.01); *H05B 6/6494* (2013.01); *B65D 81/3453* (2013.01); *B65D 5/302* (2013.01); *B65D 2581/3406* (2013.01); *B65D 2581/3447* (2013.01)

(58) Field of Classification Search

USPC ..... 206/557; 229/104, 903; 220/62, 62.1; 219/730, 104, 903

See application file for complete search history.

(56) References Cited

U.S. PATENT DOCUMENTS

| | | | | | |
|---|---|---|---|---|---|
| 622,921 | A | * | 4/1899 | Fuller | 229/104 |
| 667,634 | A | * | 2/1901 | Schmidt | 229/128 |
| 2,016,754 | A | * | 10/1935 | Perkit | 493/356 |
| 2,037,502 | A | * | 4/1936 | Cox | 206/521.4 |
| 2,043,104 | A | * | 6/1936 | Clancy | 493/128 |
| 2,232,088 | A | * | 2/1941 | Waters | 383/122 |
| 2,321,848 | A | * | 6/1943 | O'Reilly | 206/521.3 |
| 2,740,576 | A | * | 4/1956 | Franck | 229/112 |
| 2,800,893 | A | * | 7/1957 | Norman et al. | 126/262 |
| 2,836,339 | A | * | 5/1958 | Pringle | 206/521 |
| 2,858,630 | A | * | 11/1958 | Gorman | 40/539 |
| 3,276,660 | A | * | 10/1966 | Vesak | 229/117.19 |
| 3,300,117 | A | * | 1/1967 | Kossnar | 229/125.35 |
| 3,366,306 | A | * | 1/1968 | Kotowick | 229/117.25 |
| 3,425,543 | A | * | 2/1969 | Harvey | 206/432 |
| 3,447,672 | A | * | 6/1969 | Bailey et al. | 229/104 |

(Continued)

FOREIGN PATENT DOCUMENTS

| | | |
|---|---|---|
| EP | 0270838 | 6/1988 |
| EP | 1 481 922 A2 | 12/2004 |

(Continued)

OTHER PUBLICATIONS

International Search Report and Written Opinion for PCT/US2012/041199 dated Dec. 3, 2012.

*Primary Examiner* — Tu B Hoang

*Assistant Examiner* — Jimmy Chou

(74) *Attorney, Agent, or Firm* — Womble Carlyle Sandridge & Rice, LLP

(57) ABSTRACT

A tray for holding a food product includes a plurality of panels extending around an interior of the tray. The plurality of panels includes at least a central panel, at least one side panel foldably connected to the central panel, and at least one end panel foldably connected to the central panel along an arcuate fold line. The central panel forms a curved bottom surface of the tray.

20 Claims, 6 Drawing Sheets

(56) References Cited

U.S. PATENT DOCUMENTS 3,478,950 A * 11/1969 Stevens ..... 206/429
3,515,331 A 6/1970 Guthrie, Sr.
3,516,595 A * 6/1970 Bailey ..... 229/117.11
3,630,430 A * 12/1971 Struble ..... 229/117.03
3,637,130 A * 1/1972 Farquhar ..... 229/243
3,767,108 A * 10/1973 Arneson ..... 229/106
3,833,113 A * 9/1974 Osier ..... 206/216
3,845,897 A * 11/1974 Buttery et al. ..... 229/117
3,876,131 A * 4/1975 Tolaas ..... 229/104
3,877,632 A * 4/1975 Steel ..... 229/104
3,912,331 A * 10/1975 Turner et al. ..... 229/104
3,927,823 A * 12/1975 Persson ..... 229/171
4,049,188 A * 9/1977 Persson ..... 229/164.2
4,079,853 A * 3/1978 Casutt ..... 229/101
4,109,848 A * 8/1978 Kipp et al. ..... 229/104
4,124,160 A * 11/1978 Meyers et al. ..... 229/4.5
4,126,265 A * 11/1978 Holmes ..... 206/509
4,185,764 A * 1/1980 Cote ..... 229/117.03
4,205,775 A * 6/1980 Swan ..... 229/104
4,227,640 A * 10/1980 Roccaforte ..... 229/104
4,244,472 A 1/1981 Brown
4,267,955 A * 5/1981 Struble ..... 229/117.03
4,277,506 A * 7/1981 Austin ..... 426/111
4,410,129 A * 10/1983 Wischusen, III ..... 229/117.06
4,432,489 A * 2/1984 Cote ..... 229/112
4,502,623 A * 3/1985 Moore et al. ..... 229/400
4,775,771 A 10/1988 Pawlowski et al.
4,792,084 A * 12/1988 Dreeszen ..... 229/109
4,801,774 A * 1/1989 Hart ..... 219/730
4,836,439 A * 6/1989 Hart ..... 229/104
4,865,921 A 9/1989 Hollenberg et al.
4,871,111 A * 10/1989 Mode ..... 229/104
4,890,439 A * 1/1990 Smart ..... 53/410
4,915,235 A * 4/1990 Roosa ..... 229/243
4,936,935 A 6/1990 Beckett
4,963,424 A 10/1990 Beckett
5,039,364 A 8/1991 Beckett et al.
5,049,710 A * 9/1991 Prosise et al. ..... 219/730
5,077,455 A 12/1991 Peleg et al.
5,117,078 A 5/1992 Beckett
5,213,902 A 5/1993 Beckett
5,221,419 A 6/1993 Beckett
5,260,537 A 11/1993 Beckett
5,266,386 A 11/1993 Beckett
5,294,765 A * 3/1994 Archibald et al. ..... 219/727
RE34,683 E 8/1994 Maynard et al.
5,338,921 A 8/1994 Maheux et al.
5,340,436 A 8/1994 Beckett
5,351,879 A * 10/1994 Liu et al. ..... 229/104
5,354,973 A 10/1994 Beckett
5,410,135 A 4/1995 Pollart et al.
5,424,517 A 6/1995 Habeger, Jr. et al.
5,519,195 A * 5/1996 Keefer et al. ..... 219/728
5,520,322 A * 5/1996 Conviser ..... 229/110
5,628,921 A 5/1997 Beckett
5,672,407 A 9/1997 Beckett
5,720,429 A * 2/1998 Cordle ..... 229/120.18
5,726,426 A * 3/1998 Davis et al. ..... 219/730
5,759,422 A 6/1998 Schmelzer et al.
5,800,724 A 9/1998 Habeger et al.
5,816,485 A * 10/1998 Bernstein ..... 229/120
5,948,308 A * 9/1999 Wischusen, III ..... 219/730
5,961,035 A * 10/1999 Correll ..... 229/110
6,019,276 A * 2/2000 Auclair ..... 229/103.2
6,050,482 A * 4/2000 Cai ..... 229/104
6,102,281 A * 8/2000 Lafferty et al. ..... 229/185.1
6,114,679 A 9/2000 Lai et al.
6,137,099 A * 10/2000 Hamblin ..... 219/730
6,150,646 A * 11/2000 Lai et al. ..... 219/728
6,170,740 B1 * 1/2001 Clark ..... 229/117.04
6,182,890 B1 * 2/2001 Sattler et al. ..... 229/400
6,204,492 B1 * 3/2001 Zeng et al. ..... 219/728
6,251,451 B1 * 6/2001 Zeng ..... 426/107
6,414,290 B1 7/2002 Cole et al.
6,433,322 B2 8/2002 Zeng et al.
6,455,827 B2 9/2002 Zeng
6,513,704 B1 * 2/2003 Perot ..... 229/104
6,552,315 B2 4/2003 Zeng et al.
6,561,414 B1 * 5/2003 Cai ..... 229/400
6,677,563 B2 * 1/2004 Lai ..... 219/728
6,717,121 B2 4/2004 Zeng et al.
6,719,190 B2 * 4/2004 Yocum ..... 229/104
6,765,182 B2 7/2004 Cole et al.
7,007,838 B1 * 3/2006 Bostick, II ..... 229/192
7,019,271 B2 3/2006 Wnek et al.
7,140,532 B2 * 11/2006 Holt et al. ..... 229/120.13
7,219,828 B2 * 5/2007 Lombardo ..... 229/92.1
7,273,162 B2 * 9/2007 Baker ..... 229/120.13
7,323,669 B2 1/2008 Robison et al.
7,351,942 B2 * 4/2008 Wnek et al. ..... 219/730
7,365,292 B2 * 4/2008 Cole et al. ..... 219/730
7,473,875 B2 * 1/2009 Fitzwater ..... 219/730
7,514,659 B2 4/2009 Lafferty
7,541,562 B2 * 6/2009 Cole et al. ..... 219/730
7,648,031 B2 * 1/2010 Kari ..... 206/591
7,667,167 B2 * 2/2010 Fitzwater ..... 219/730
7,748,536 B2 * 7/2010 Cassese et al. ..... 206/542
7,762,394 B2 * 7/2010 Bradford et al. ..... 206/427
7,793,821 B2 * 9/2010 Oliveira ..... 229/104
7,798,327 B1 * 9/2010 Berkani et al. ..... 206/440
7,824,719 B2 * 11/2010 Cole et al. ..... 426/107
7,893,389 B2 * 2/2011 Fitzwater ..... 219/730
7,975,871 B2 7/2011 Wnek et al.
7,982,167 B2 7/2011 Fitzwater
7,982,349 B2 7/2011 Popov et al.
8,013,280 B2 9/2011 Robison et al.
8,063,344 B2 * 11/2011 Cole et al. ..... 219/730
8,087,570 B2 * 1/2012 Ho Fung ..... 229/109
8,106,339 B2 * 1/2012 Robbins et al. ..... 219/730
8,158,914 B2 4/2012 Wnek et al.
8,183,506 B2 * 5/2012 Fitzwater ..... 219/730
8,252,217 B2 8/2012 Wnek et al.
8,309,896 B2 11/2012 Fitzwater
8,492,690 B1 * 7/2013 Watkins ..... 219/730
2002/0084319 A1 * 7/2002 Yocum ..... 229/405
2003/0006273 A1 * 1/2003 Tsern et al. ..... 229/115
2003/0226881 A1 * 12/2003 Liou ..... 229/169
2004/0232034 A1 * 11/2004 Lebras ..... 206/557
2004/0238534 A1 * 12/2004 Mast ..... 219/730
2005/0082355 A1 * 4/2005 Beutler ..... 229/116.1
2005/0194286 A1 * 9/2005 Ilyayeva et al. ..... 206/557
2005/0205565 A1 * 9/2005 Cole et al. ..... 219/730
2006/0049190 A1 * 3/2006 Middleton et al. ..... 219/730
2006/0096978 A1 * 5/2006 Lafferty et al. ..... 219/730
2006/0113300 A1 * 6/2006 Wnek et al. ..... 219/730
2006/0180644 A1 * 8/2006 Baker ..... 229/120.18
2006/0278521 A1 12/2006 Stowell
2007/0102424 A1 * 5/2007 Keefe ..... 219/725
2007/0131744 A1 * 6/2007 Fitzwater ..... 229/101.1
2007/0131745 A1 * 6/2007 Fitzwater ..... 229/101.1
2007/0215611 A1 * 9/2007 O'Hagan et al. ..... 219/730
2007/0251942 A1 * 11/2007 Cole et al. ..... 219/730
2007/0251943 A1 * 11/2007 Wnek et al. ..... 219/730
2007/0275130 A1 * 11/2007 Cole et al. ..... 426/107
2008/0000897 A1 * 1/2008 Robbins et al. ..... 219/730
2008/0023469 A1 * 1/2008 Fitzwater ..... 219/730
2008/0047958 A1 2/2008 Cole et al.
2008/0078759 A1 * 4/2008 Wnek et al. ..... 219/730
2008/0081095 A1 * 4/2008 Cole et al. ..... 426/107
2008/0110966 A1 * 5/2008 Yocum ..... 229/114
2009/0072015 A1 * 3/2009 Drew et al. ..... 229/102
2009/0090708 A1 * 4/2009 Requena et al. ..... 219/730
2009/0218338 A1 * 9/2009 Futzwater ..... 219/730
2010/0025393 A1 * 2/2010 Talpaert ..... 219/730
2010/0038359 A1 * 2/2010 Laubhan et al. ..... 219/730
2010/0051675 A1 * 3/2010 Sweet ..... 229/115
2010/0065556 A1 * 3/2010 Cole ..... 219/730
2010/0065621 A1 * 3/2010 Quaintance ..... 229/191
2010/0072197 A1 * 3/2010 Neff et al. ..... 219/730
2010/0122999 A1 * 5/2010 Brand ..... 229/120.18
2010/0193509 A1 * 8/2010 Fitzwater ..... 219/730
2010/0264135 A1 * 10/2010 Cole ..... 219/730
2011/0024413 A1 * 2/2011 Cole ..... 219/730
2011/0114715 A1 * 5/2011 House ..... 229/120

(56) References Cited

U.S. PATENT DOCUMENTS

| | | | | |
|---|---|---|---|---|
| 2011/0132903 | A1* | 6/2011 | Cole | 219/730 |
| 2011/0233266 | A1* | 9/2011 | Pezzoli | 229/235 |
| 2013/0087607 | A1* | 4/2013 | Learn | 229/124 |

FOREIGN PATENT DOCUMENTS

| | | | | |
|---|---|---|---|---|
| EP | 1 364 558 | B1 | 3/2005 | |
| EP | 2240385 | * | 6/2008 | B65D 71/34 |
| FR | 2 867 346 | | 9/2005 | |
| JP | 4-253670 | | 9/1992 | |
| WO | WO 94/05563 | | 3/1994 | |
| WO | WO 02/060223 | A1 | 8/2002 | |
| WO | WO 03/066435 | A2 | 8/2003 | |
| WO | WO 2005/077783 | A1 | 8/2005 | |
| WO | WO 2006/076501 | A1 | 7/2006 | |
| WO | WO 2007/127235 | A2 | 11/2007 | |
| WO | WO 2007/133659 | A2 | 11/2007 | |
| WO | WO 2007/136839 | A2 | 11/2007 | |

* cited by examiner 101
105
110
112
114
116
118
120
122
124
125
126
128
130
132
134
136
138
140
142
144
146
148
150
152
154
156
158
160
162
1A
C1
C2
C3
L1
L2

TRAY WITH CURVED BOTTOM SURFACE

CROSS-REFERENCE TO RELATED APPLICATIONS

This application claims the benefit of U.S. Provisional Application No. 61/520,345, which was filed on Jun. 8, 2011.

INCORPORATION BY REFERENCE

U.S. Provisional Application No. 61/520,345, which was filed on Jun. 8, 2011, is hereby incorporated by reference for all purposes as if presented herein in its entirety.

BACKGROUND OF THE DISCLOSURE

The present disclosure generally relates to cartons or trays for holding and/or cooking food products or other types of articles. More specifically, the present disclosure relates to materials and constructs that may be used to prepare foods in a microwave oven.

SUMMARY OF THE DISCLOSURE

In general, one aspect of the disclosure is generally directed to a tray for holding a food product. The tray includes a plurality of panels extending around an interior of the tray. The plurality of panels includes at least a central panel, at least one side panel foldably connected to the central panel, and at least one end panel foldably connected to the bottom panel along an arcuate fold line. The central panel forms a curved bottom surface of the tray.

Another aspect of the disclosure is generally directed to a blank for forming a tray for holding a food product. The blank includes a plurality of panels configured to extend around an interior of a constructed tray. The plurality of panels includes at least a central panel, at least one side panel foldably connected to the central panel, and at least one end panel foldably connected to the bottom panel along an arcuate fold line. The central panel is configured to form a curved bottom surface of the tray.

Yet another aspect of the disclosure is generally directed to a method of forming a tray for holding a food product. The method includes obtaining a blank comprising a plurality of panels comprising at least a central panel, at least one side panel foldably connected to the central panel, and at least one end panel foldably connected to the central panel along an arcuate fold line. The method further includes forming at least a portion of an interior of the tray by folding the at least one side panel relative to the central panel, and forming a curved bottom surface of the tray by folding the at least one end panel relative to the central panel along the first arcuate fold line.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The package of the present disclosure can be useful in containing a food product or other article such as any suitable type of food product that can be heated or cooked in a microwave oven. For example, the food product could include frozen food products or non-frozen food products. Some suitable food products could comprises a frozen pizza, a frozen French bread pizza, a frozen sandwich, frozen vegetables, popcorn, or any other suitable food product. Further, the package of the present disclosure can be used for heating, cooking, browning, crisping, etc. the food product by use of a heating or cooking device such as a microwave oven. It is understood that food products other than the food products listed herein may be contained in the package. Further, food products contained in this package may be generally rectangular, triangular, round, square, irregular, or any other shape. In this specification, the terms "lower," "bottom," "upper," and "top" indicate orientations determined in relation to fully erected and upright packages.

Figures 1, 1A:
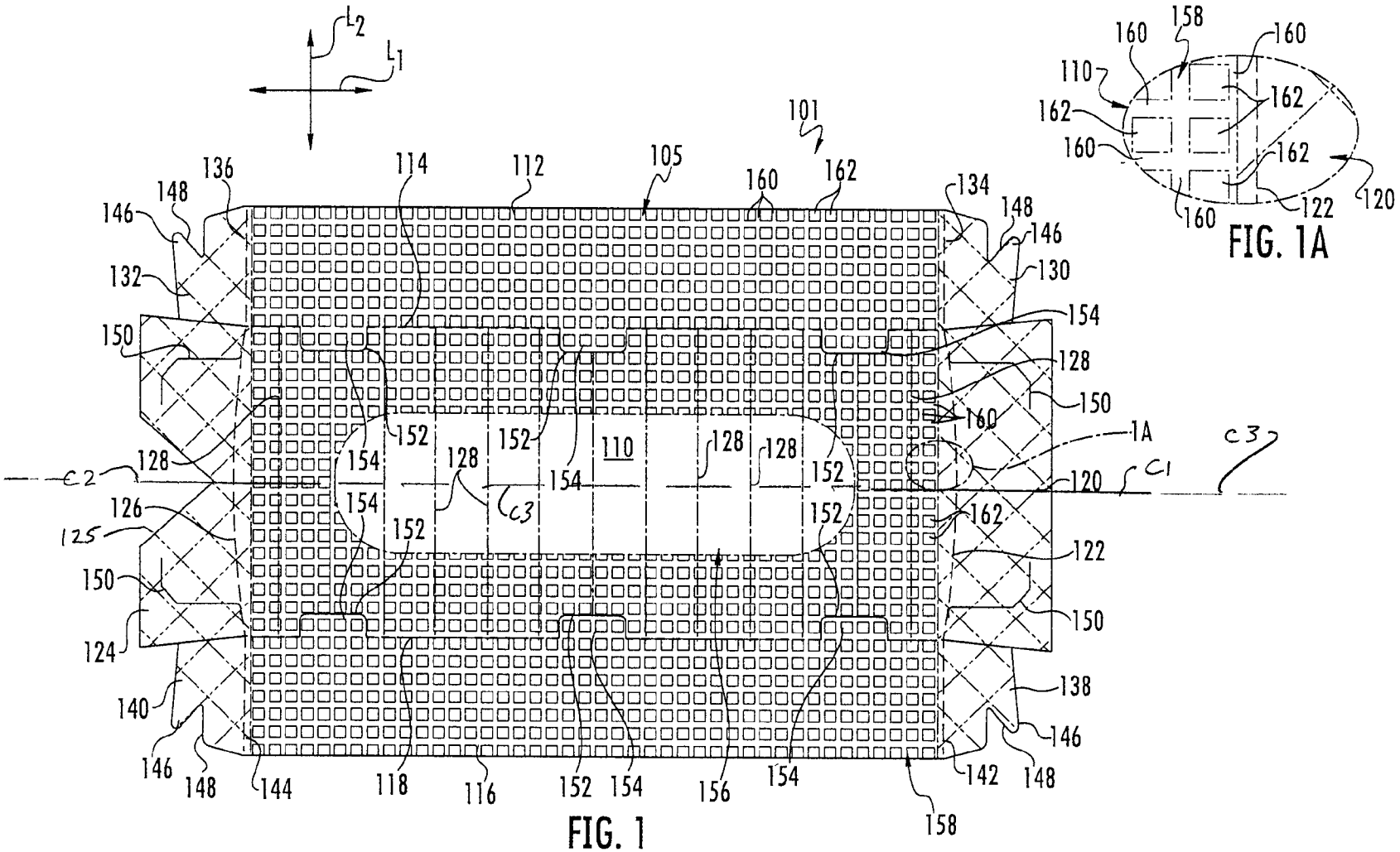
FIG. 1 is a plan view of a blank used to form an exemplary tray according to a first embodiment of the present disclosure.
FIG. 1A is a detail view of a portion of the blank of FIG. 1.
Figure 4:
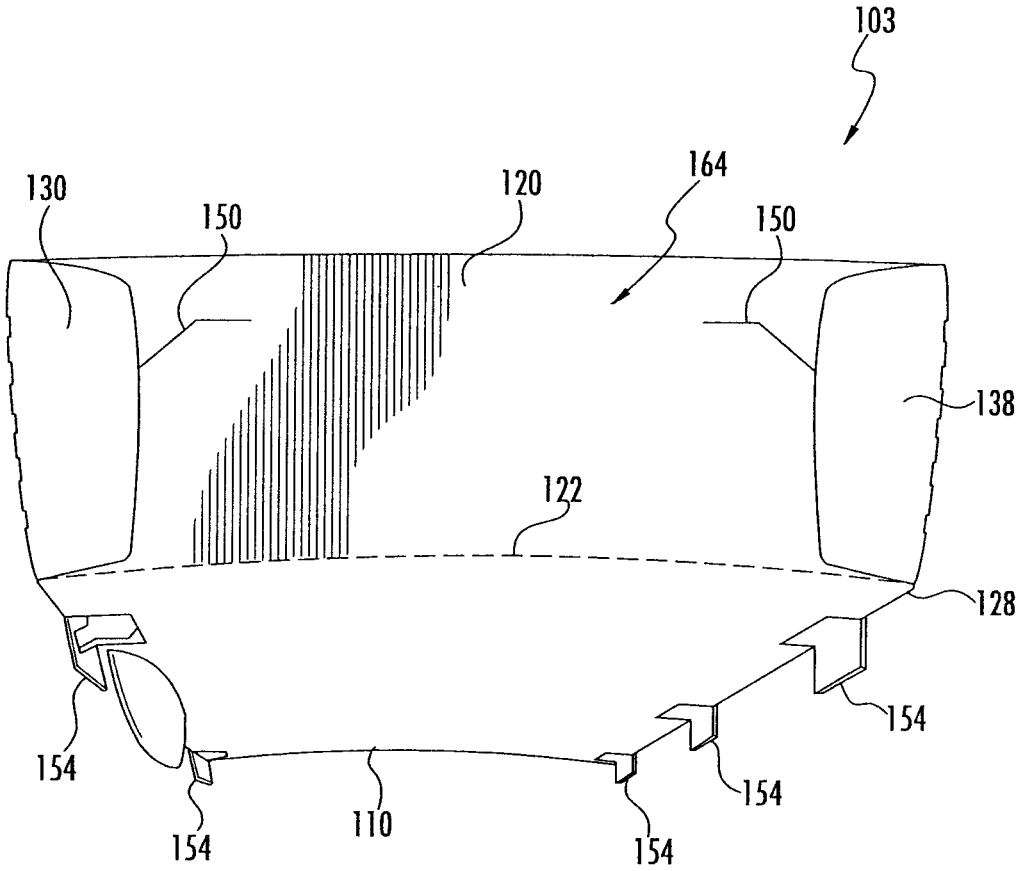
FIG. 4 is an end elevation view of a tray formed from blank of FIG. 1.
Figure 5:
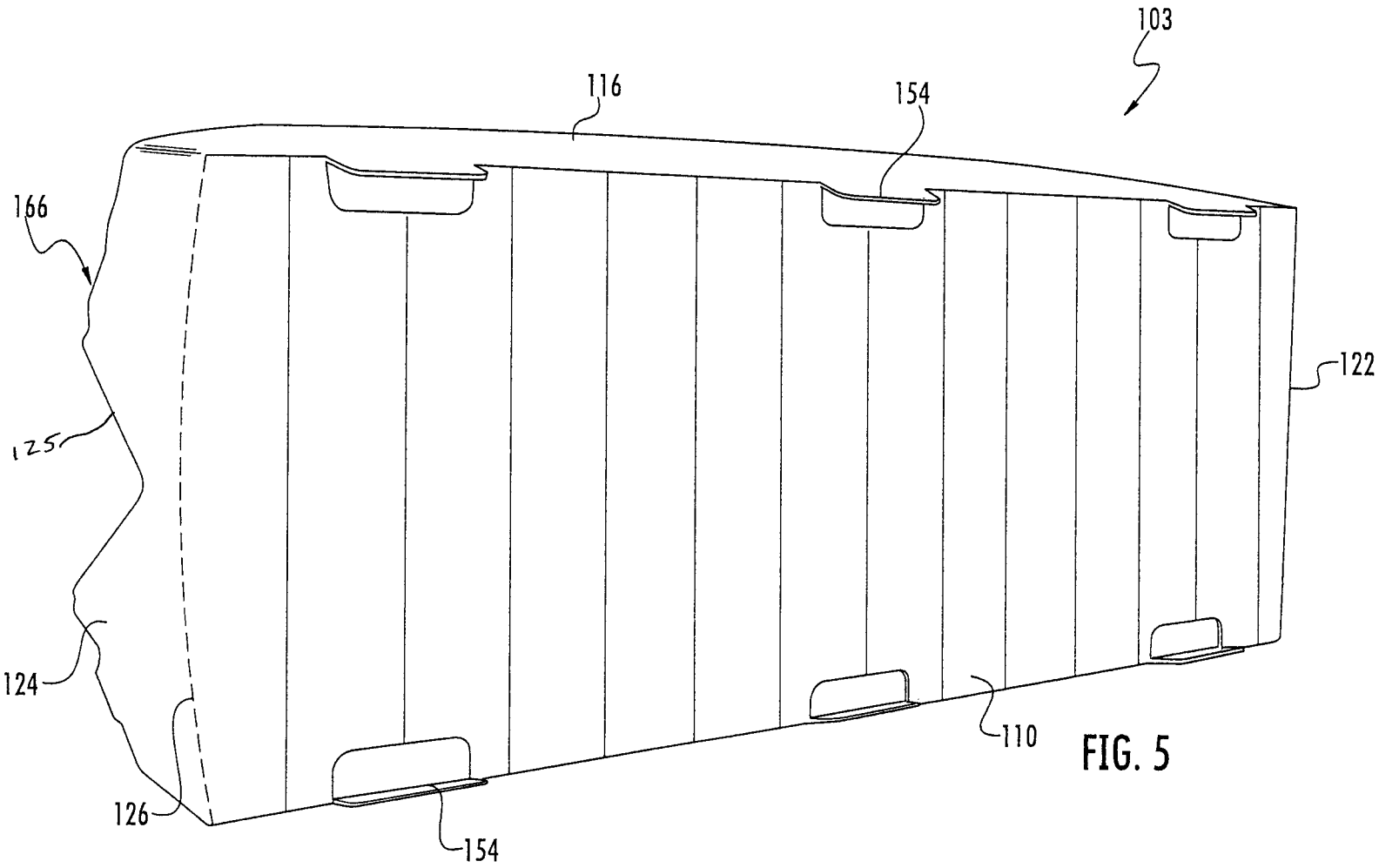
FIG. 5 is a bottom perspective view of a tray formed from blank of FIG. 1.

FIG. 1 is a plan view of a blank, generally indicated at 101, used to form a package or tray 103 (FIGS. 3-5) of an exemplary embodiment of the disclosure. The tray 103 is used to hold a food product (not shown), such as a French bread pizza, sandwich, calzone, turnover, burrito, or any other food product, during cooking of the food product. In one example, the tray 103 with a food product is placed in a microwave oven (not shown) to heat and/or cook the food product. At least a portion of the tray 103 may have an element for use in cooking, heating, browning, and/or shielding (e.g., a microwave energy interactive element 105 such as, but not limited to, a susceptor) mounted thereto. Alternatively, the microwave energy interactive element 105 can be omitted from the tray 103.

The blank 101 has a longitudinal axis L1 and a lateral axis L2. The blank 101 includes a central panel 110 foldably connected to a first side panel 112 at a first longitudinal fold line 114. A second side panel 116 is foldably connected to the central panel 110 along a second longitudinal fold line 118. A first end panel 120 is foldably connected to the central panel 110 at a first arcuate fold line 122 at one longitudinal end of the central panel 110, and a second end panel 124 is foldably connected to the central panel 110 at a second arcuate fold line 126 at another longitudinal end of the central panel 110. As shown in FIG. 1, the central panel 110 can include a plurality (e.g., about 13) lateral fold lines or scores 128. Only a representative few of the scores 128 are identified by their reference numbers in FIG. 1. Alternatively, the lateral scores 128 can be omitted or otherwise configured, arranged, or positioned without departing from the scope of the disclosure. 14.

In one embodiment, the first arcuate fold line 124 and the second arcuate fold line 126, have a respective central axis C1, C2 that lie along or are generally collinear with the radius of curvature of each of the arcuate fold lines. The respective central axis C1, C2 of the first arcuate fold line 124 and the second arcuate fold line 126 can be aligned with or collinear with each other, and both respective central axis of the arcuate fold lines can be aligned with or collinear with a central axis C3 of the blank 101 and/or tray 103 without departing from the disclosure. The first arcuate fold line 124 and second arcuate fold line 126 could be otherwise shaped, arranged, and/or configured without departing from the disclosure. For example the fold lines 124, 126 could be otherwise arranged such that central axis C1, C2 are not aligned with the central axis C3 of the tray without departing from the disclosure.

In the illustrated embodiment, the blank 101 includes side end flaps 130, 132 foldably connected to the first side panel 112 along respective lateral fold lines 134, 136 at respective ends of the first side panel 112. Side end flaps 138, 140 are respectively foldably connected to the second side panel 116 along the respective lateral fold lines 142, 144 at respective ends of the second side panel 116. Each of the side end flaps 130, 138, 132, 140 includes a locking feature, such as a projection 146 and a recess 148 for engaging a respective slit 150 in a respective end panel 120, 124. The side end flaps could be otherwise shaped, arranged, positioned, and/or configured without departing from the disclosure. For example, the locking features can be omitted from the side end flaps 130, 132, 138, 140 and the end panels 120, 124, and the side end flaps 130, 138, 132, 140 can be glued to the respective end panels 120, 124. Alternatively, the side end flaps 130, 132, 138, 140 could be omitted from the blank 101 without departing from the disclosure.

In one embodiment, the end panel 124 includes a notch 125 located approximately in the center of the end panel, and the end panel 120 is free generally rectangular. In one embodiment, the notch 125 is generally V-shaped with the corner of the notch being aligned with the central axis C3 of the blank 101. The notch 125 can be for accessing a product held in the tray 103. The notch 125 could be otherwise shaped, arranged, configured, and/or omitted without departing from the disclosure. Further the notch 125 could be replaced with a removable panel defined by a tear line for separating the removable panel from the end panel 124. In such an alternative embodiment, access to a product in the tray 103 can be facilitated by removal of the removable panel.

As shown in FIG. 1, each of the longitudinal fold lines 114, 118 can be interrupted by three spaced-apart, generally curved or U-shaped cut lines 152 forming extensions 154 extending from the first and second side panels 112, 116. In the illustrated embodiment, the extensions 154 extend downwardly from the first and second side panels 112, 116 below the central panel 110 to elevate the central panel 110 above a support surface (e.g., a table, a microwave oven floor, etc.). Alternatively, the curved cut lines 152 and the extensions 154 could be omitted or otherwise shaped, arranged, positioned, and/or configured without departing from the disclosure.

In the illustrated embodiment, the microwave interactive element 105 extends at least partially across the interior surface of the central panel 110 and the first and second side panels 112, 126. In one embodiment, the microwave interactive element 105 comprises a center portion 156 and a patterned portion 158. The center portion 156 can be generally shaped as a rectangle with each end capped with a semicircle. Alternatively, the center portion 156 can comprise any suitable shape or can be omitted. As shown in FIG. 1A, in detail, the patterned portion 158 can include several crossed longitudinal and lateral lines 160 forming an array of generally square portions 162 that are void of the microwave interactive element 105. The microwave interactive element 105 could be omitted or otherwise shaped, arranged, positioned, and/or configured without departing from the disclosure. For example, the microwave interactive element 205, shown in FIG. 6, covers substantially all of the interior surface of the tray 203.

The microwave interactive element 105 can be attached to the blank 101 by adhesive material (not shown) or by any other suitable mechanism. It is understood that the adhesive attaching the microwave interactive element 105 to the blank 101 may be a patterned layer of adhesive such as evenly spaced spots of adhesive or the adhesive could be otherwise applied without departing from the scope of this disclosure.

The material of the microwave interactive element 105 can be, or include, any type of known microwave interactive material, such as a susceptor that is for absorbing microwaves and/or converting microwaves into thermal energy to thereby become hot and to at least radiantly provide heat to food, a microwave energy shielding element that is for reflecting microwaves away from at least a portion of a food item, a microwave energy directing element for directing microwaves toward at least a portion of a food item, and various combinations of these and other features. In accordance with exemplary embodiments of the present disclosure, the material of the microwave interactive element 105 can more specifically be a microwave insulating material in contact with the food product for heating, browning, and/or crisping the food product during operation of the microwave oven. It is understood that the food product may be a type of food product that may or may not require browning or crisping during microwave heating without departing from the scope of this disclosure.

According to various aspects of the present disclosure, the material of the microwave interactive element 105 of the present disclosure could be any arrangement of layers, such as polymer (e.g., polyester) film layers, susceptor or "microwave interactive" layers, paper layers, continuous and discontinuous adhesive layers, and patterned adhesive layers, that provides an insulating effect. The material of the microwave interactive element 105 may include one or more susceptors, one or more expandable insulating cells, or a combination of susceptors and expandable insulating cells. Examples of materials that may be suitable, alone or in combination, include, but are not limited to, QWIKWAVE® brand susceptor, QWIKWAVE FOCUS® brand susceptor, MICRO-RITE® brand susceptor, MICROFLEX Q® brand susceptor, and QUILTWAVE® brand susceptor, each of which is commercially available from Graphic Packaging International, Inc. The material may be any suitable expandable cell material as desired, and, in some instances, may include any of the materials described herein, any of the materials described in International Publication No. WO 03/066435, published Aug. 14, 2003, which is entirely incorporated by reference herein, or any combination thereof. Alternatively and as should be apparent from the foregoing, as one example the microwave interactive element 105 can consist essentially solely of a susceptor.

Alternatively or additionally, any of the blanks, packages, or other constructs of the present disclosure may be coated or laminated with other materials to impart other properties, such as absorbency, repellency, opacity, color, printability, stiffness, or cushioning. For example, absorbent susceptors are described in U.S. Patent Application Publication No. 2006/0049190, published Mar. 9, 2006, which is incorporated herein by reference in its entirety. Additionally, the blanks or other constructs may include graphics or indicia printed thereon.

The microwave interactive element 105 can include other materials than described herein and may be otherwise arranged, configured, and/or designed without departing from the scope of the disclosure. Further, multiple layers of microwave interactive element 105 can be used in the tray 103. Alternatively, the microwave interactive element can be omitted without departing from the scope of the disclosure.

In alternative embodiments, the blank 101 could be otherwise shaped, arranged, and/or configured.

Figure 2:
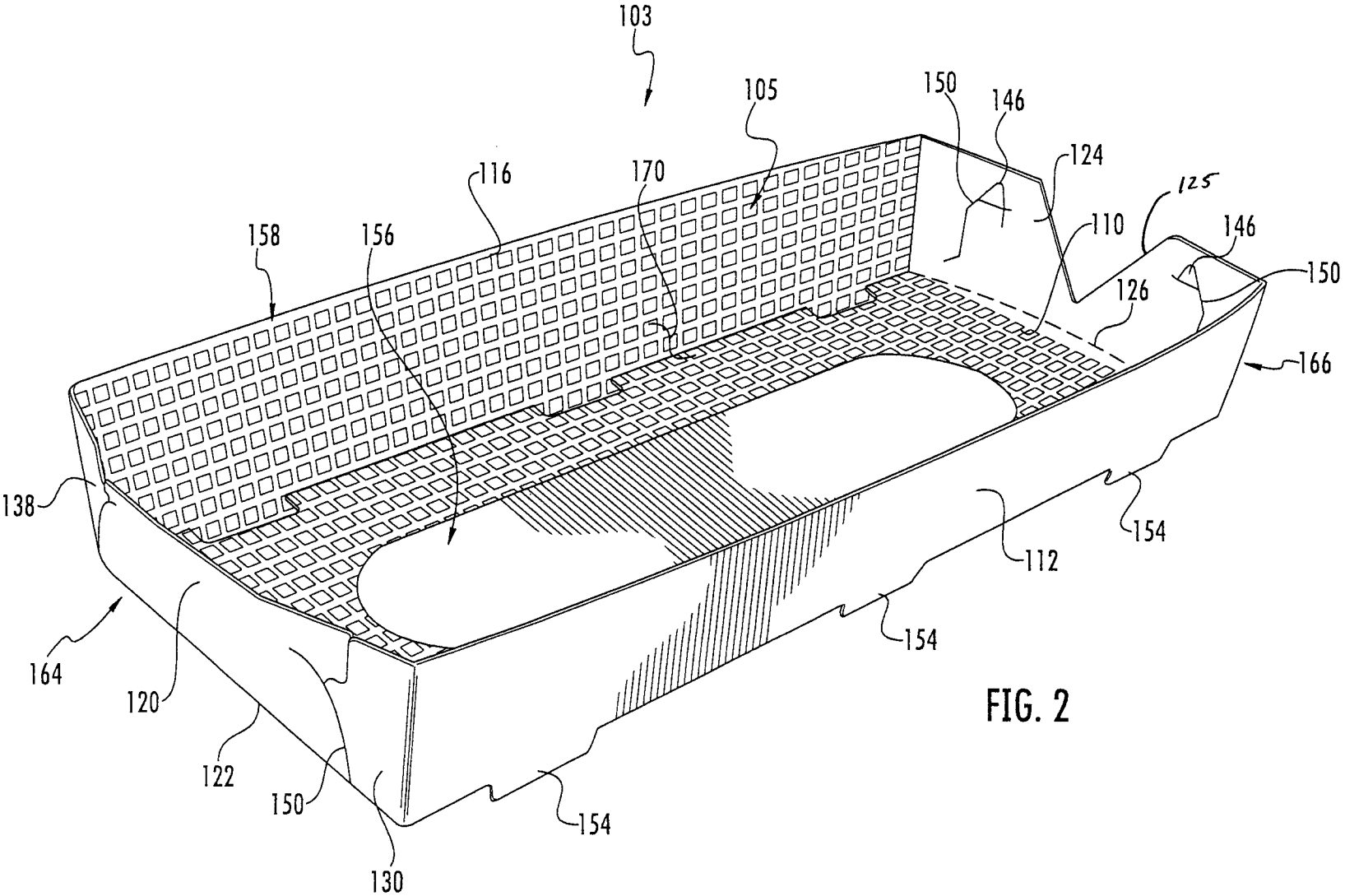
FIG. 2 is a first end perspective view of a tray formed from blank of FIG. 1.
Figure 3:
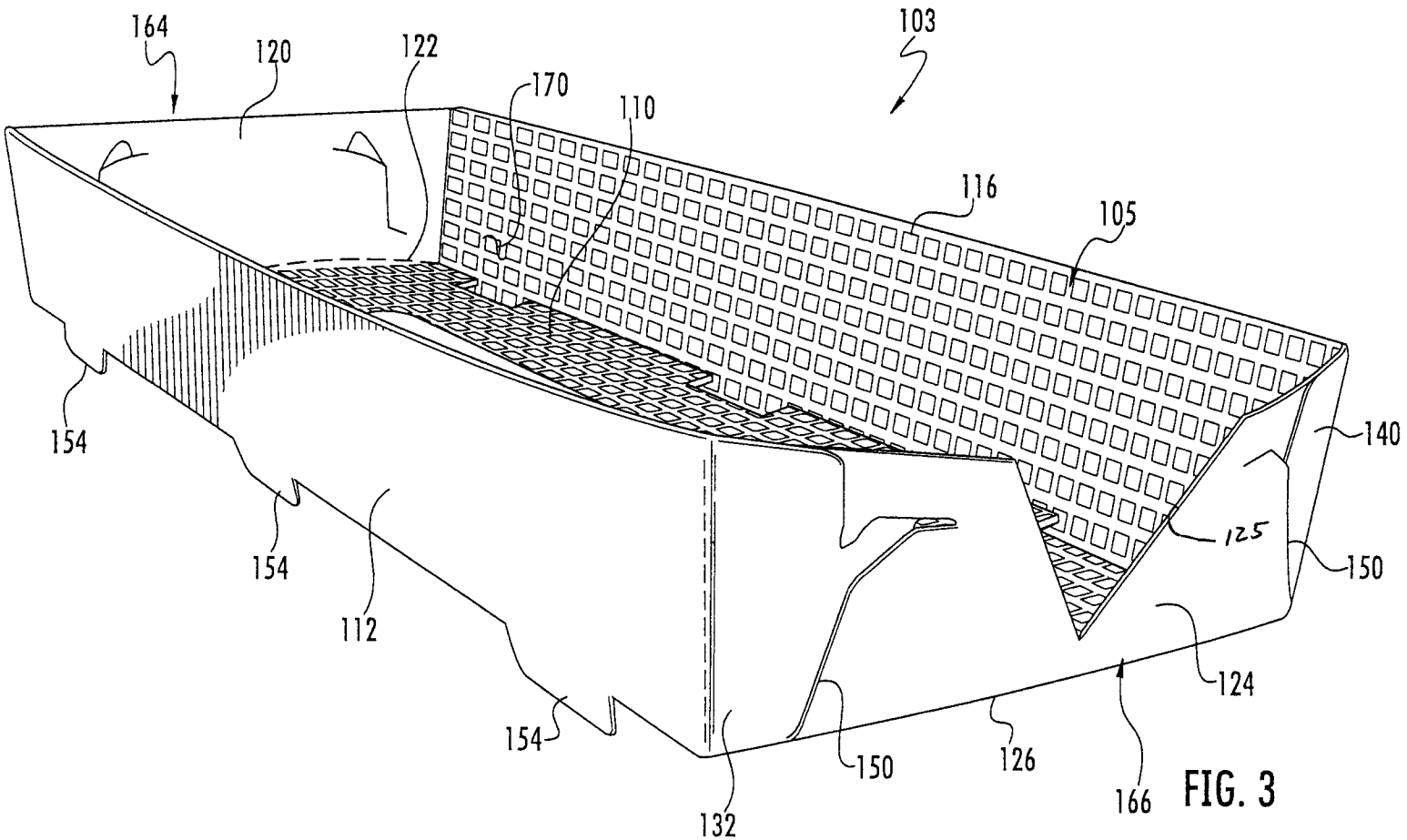
FIG. 3 is a second end perspective view of a tray formed from blank of FIG. 1.

As shown in FIG. 2 and described in the following in accordance with one acceptable example, the tray 103 is formed from the blank 101 by upwardly folding the side panels 112, 116 along the respective longitudinal fold lines 114, 118 and folding the end panels 120, 124 along the respective arcuate fold lines 122, 126. Folding the side panels 112, 116 upwardly causes the extensions 154 to separate from the central panel 110 along the curved cut lines 152 and extend downwardly to elevate the central panel 110. Accordingly, the extensions 154 can act as legs that help separate the central panel 110 from a support surface such as a table top or counter. Folding the end panels 120, 124 along the arcuate fold lines 122, 126 can cause the central panel 110 to curve or arch upwardly, conforming to the curve of the arcuate fold lines 122, 126. Thus, the curvature of the central panel 110 is defined by the arcuate fold lines 122, 126. Accordingly, the central panel 110 arches or extends into an interior 170 of the tray 103. For example, a medial portion of the central panel 110 extends into the interior 170 of the tray 103 such that the medial portion of the central panel is closer to the top of the tray than distal portions of the central panel that are near or closely adjacent the side panels 112, 116. Each of the side end flaps 130, 138 can be folded along the respective lateral fold lines 134, 142 into face-to-face contact with the exterior surface of the first end panel 120 and inserted into the respective slit 150 so that the projections 146 and recesses 148 engage the respective slits 150. Accordingly, the first end panel 120 and the side end flaps 130, 138 form a first closed end 164 of the tray 103. Similarly, a second closed end 166 of the tray 103 is formed by folding the side end flaps 132, 140 along the respective lateral fold lines 136, 144 into face-to-face contact with the exterior surface of the second end panel 124 and inserting the side end flaps 132, 140 into the respective slit 150 so that the projections 146 and recesses 148 engage the respective slits 150. Alternatively, the side end flaps 130, 138, 132, 140 can be folded into face-to-face contact with the interior surface of the respective end panels 120, 124. As shown in FIGS. 2 and 3, the arched central panel 110, the side panels 112, 110, and the closed ends 164, 166 form the interior 170 of the tray 103. Alternative assembling, loading, and closing steps may be used without departing from the scope of the disclosure. For example, the side end flaps 130, 138, 132, 140 can be glued into face-to-face contact with the respective end panels 120, 124 in addition, or alternatively, to interlocking the side end flaps to the end panels via the projections 146 and the slits 150.

In the illustrated embodiment, the arched central panel 110 forms a convex or curved bottom surface of the tray 103 that supports a food product. The arched central panel 110 can help provide better contact between the microwave interactive element 105 and a food product (not shown) in the tray than a flat bottom panel. Improved contact between a food product and the microwave interactive element 105 can help improve the cooking performance of the tray 103. Additionally, or alternatively, the arched central panel 110 can help provide better support for the food product than a flat bottom panel. For example, where a flat bottom panel might sag or bow downwardly toward a support surface (e.g., a floor of a microwave oven) under the weight of a food product, the arched central panel resists sagging to help maintain separation from the support surface.

In an alternative embodiment (not shown), the extensions 154 can be omitted so that the longitudinal fold lines 114, 118 rest on the support surface and at least a portion of the arched central panel 110 arches away from the support surface.

Figure 6:
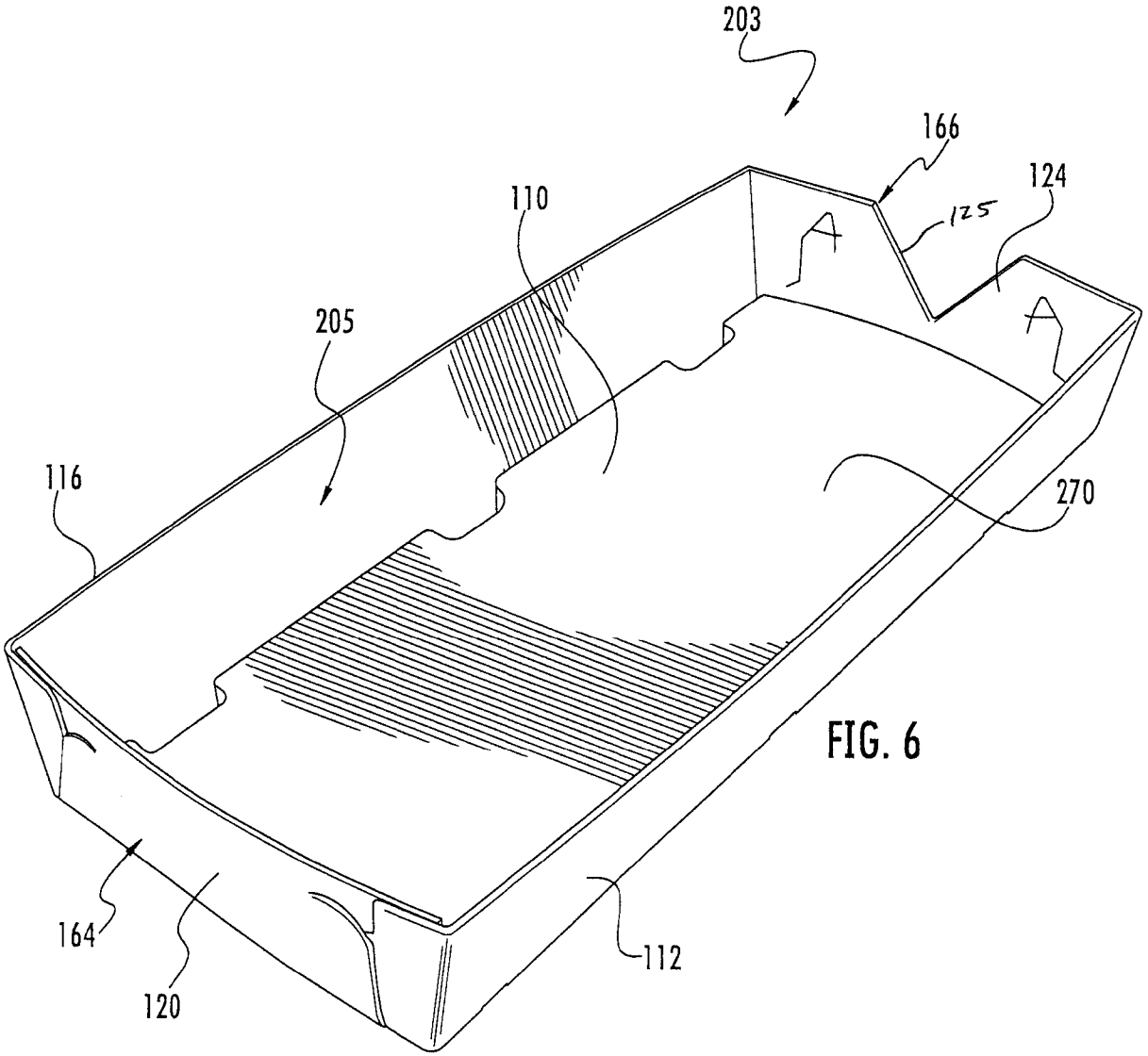
FIG. 6 is a perspective view of a tray according to a second embodiment of the disclosure.

FIG. 6 illustrates a tray 203 according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 6, the tray 203 includes an interior 270 formed by the arched central panel 110, the side panels 112, 116, and the closed ends 164, 166. A microwave interactive element 205 covers substantially all of the interior surface of the central panel 110, the side panels 112, 116, and the closed ends 164, 166. As with the previous embodiments, the interior 270 of the tray 203 has a convex or curved bottom surface formed by the arched central panel 110.

In general, any blank as described above may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blank may then be coated with a varnish to protect information printed on the blanks. The blank may also be coated with, for example, a moisture barrier layer, on either or both sides of the blanks. The blank can also be laminated to or coated with one or more sheet-like materials at selected panels or panel sections.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A tray for holding a food product, the tray comprising:

a plurality of panels extending around an interior of the tray, the plurality of panels comprising a longitudinal central panel, a first side panel foldably connected to the central panel at a first longitudinal fold line, a second side panel foldably connected to the central panel at a second longitudinal fold line, a first end panel foldably connected to the central panel along a first arcuate fold line, and a second end panel foldably connected to the central panel along a second arcuate fold line, wherein the central panel forms a curved bottom surface of the tray and the central panel includes a plurality of reinforcement lateral fold lines extending from the first longitudinal fold line to the second longitudinal fold line, the plurality of reinforcement lateral fold lines are equally spaced across the length of the central panel in the same direction with the first and the second longitudinal fold lines to reinforce and strengthen the central panel, and the second end panel comprises a notch arranged therethrough configured to allow access to one end of a food product.

2. The tray of claim 1, wherein curvature of the curved bottom surface is defined by at least one of the first and second arcuate fold lines.

3. The tray of claim 2, wherein the curved bottom surface includes a portion of the central panel extending into an interior of the tray.

4. The tray of claim 1, wherein the curved bottom surface is arranged to support a food product.

5. The tray of claim 1, further comprising:

at least one extension extending from at least one of the first side panel and the second side panel, the at least one extension is configured to elevate the central panel.

6. The tray of claim 5, wherein the at least one extension is defined by a curved cut-line cut through the central panel.

7. The tray of claim 1, wherein the first and second side panels comprise respective locking flaps configured to engage the first and second end panels to form the tray.

8. The tray of claim 1, wherein curvature of the curved bottom surface is defined by the first and second arcuate fold lines.

9. The tray of claim 1, further comprising:

a plurality of extensions extending from the first and second side panels configured to elevate the central panel.

10. The tray of claim 9, wherein the plurality of extensions are defined by curved cut-lines cut through the central panel.

11. The tray of claim 1, wherein a central axis of the second arcuate fold line is collinear with a central axis of the first arcuate fold line.

12. The tray of claim 1, further comprising:

an interactive element arranged on the central panel.

13. The tray of claim 12, wherein the interactive element is a radio-opaque element configured to interact with a microwave oven.

14. The tray of 12, wherein the interactive element comprises a metallic inlay.

15. The tray of 14, wherein the metallic inlay comprises a grid of interlocking metallic traces.

16. The tray of claim 15, wherein the metallic inlay further comprises an oblong central interactive element.

17. The tray of claim 16, wherein the oblong central interactive element is arranged to contact a major surface of a food product.

18. The tray of claim 1, further comprising:

an interactive element arranged on at least one of the central panel, the at least one side panel, and the at least one end panel.

19. The tray of claim 1, wherein the plurality of reinforcement lateral fold lines extends between the first side panel and the second side panel.

20. The tray of claim 1, wherein the plurality of reinforcement lateral fold lines comprise at least three lateral fold lines.

* * * * *